United States Patent [19]

Stuckas

[11] 4,305,364

[45] Dec. 15, 1981

[54] FUEL CONTROL SYSTEM

[75] Inventor: Kenneth J. Stuckas, Mobile, Ala.

[73] Assignee: Teledyne Industries, Inc., Los Angeles, Calif.

[21] Appl. No.: 88,767

[22] Filed: Oct. 29, 1979

[51] Int. Cl.[3] ..... F02M 7/00; F02B 3/00

[52] U.S. Cl. ..... 123/440; 60/39.28 R; 123/486; 123/489

[58] Field of Search ..... 123/119 R, 117 A, 32 EA; 60/39.28

[56] References Cited

U.S. PATENT DOCUMENTS

| | | | |
|---|---|---|---|
| 3,142,967 | 8/1964 | Schweitzer | 123/117 A |
| 3,596,643 | 8/1971 | Schweitzer | 123/117 A |
| 3,911,285 | 10/1975 | Yannone et al. | 60/39.28 |
| 3,987,620 | 10/1976 | Giordano et al. | 60/39.28 |
| 4,004,412 | 6/1977 | Burnell | 60/39.28 |
| 4,015,569 | 4/1977 | Leshner et al. | 123/119 R |
| 4,015,572 | 4/1977 | Leshner et al. | 123/119 R |
| 4,232,643 | 11/1980 | Leshner et al. | 123/440 |
| 4,241,710 | 12/1980 | Peterson, Jr. et al. | 123/440 |

*Primary Examiner*—Charles J. Myhre
*Assistant Examiner*—R. A. Nelli
*Attorney, Agent, or Firm*—Gifford, VanOphem, Sheridan & Sprinkle

[57] ABSTRACT

A fuel control system is provided for a spark-ignition internal combustion engine having a source of fuel and means for supplying the fuel from the fuel source and to the engine at variable flow rates. The fuel control method of the present invention is particularly suited for a reciprocating piston aircraft engine and is designed to minimize brake specific fuel consumption of the engine during operation at constant engine rotational speed and load but is capable of supplying additional fuel to the engine during transient operation, for example during an acceleration phase. In brief, when the engine is operating under constant engine rotational speed and load, an engine parameter, such as the exhaust gas temperature, which is correlated to the brake specific fuel consumption for the engine is iteratively sensed and compared to the previously determined value for this parameter. As a result of this comparison, the fuel flow rate to the engine is either stepwise increased or stepwise decreased by predetermined fuel flow increments designed to minimize the brake specific fuel consumption. Moreover, as the fuel flow rate to the engine nears the minimum point for brake specific fuel consumption, the fuel flow rate to the engine is alternatively stepwise increased and stepwise decreased by decreasing fuel flow increments. When the fuel flow increments become less than the predetermined amount, the fuel flow rate to the engine is maintained at its last value until a subsequent change in the engine operating conditions occurs.

9 Claims, 5 Drawing Figures

Fig-4
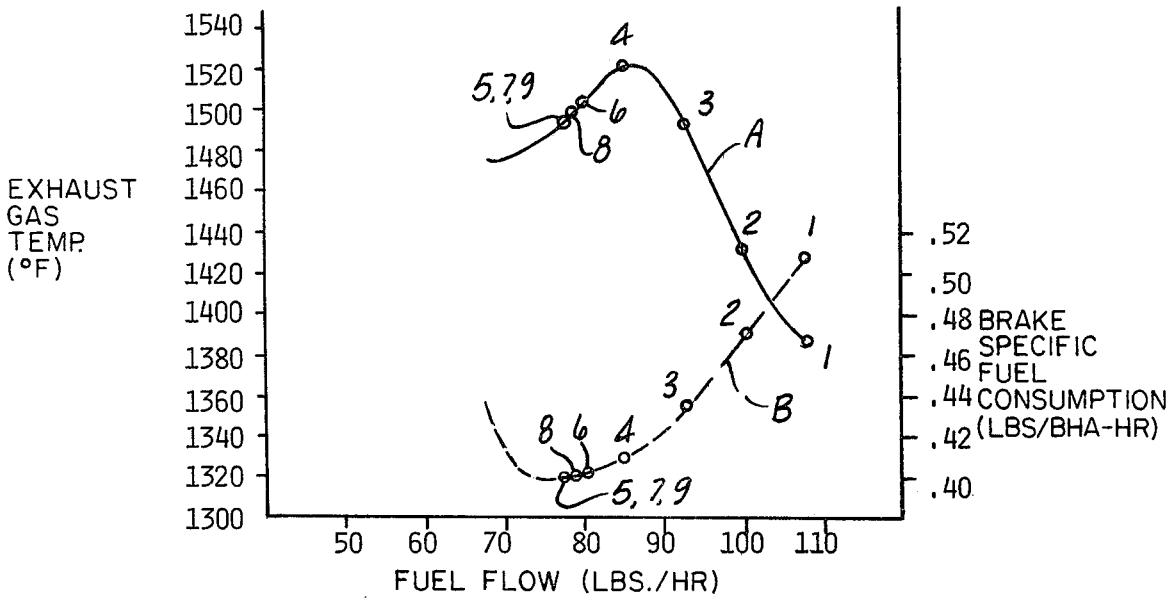
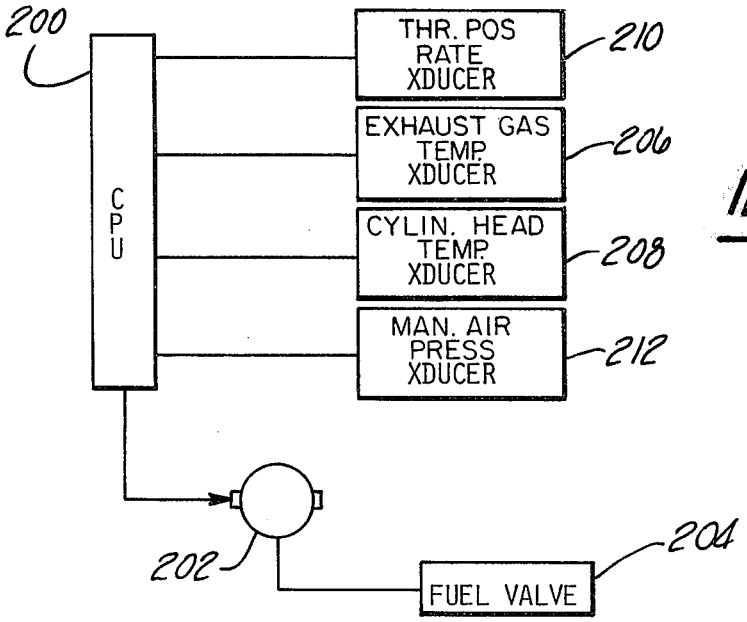
Fig-3

FUEL CONTROL SYSTEM

BACKGROUND OF THE INVENTION

I. Field of the Invention

The present invention relates to fluid control systems and, more particularly, to a fuel control system for an internal combustion engine.

II. Description of the Prior Art

In spark-ignition internal combustion engines, such as aircraft piston engines, the engine is normally supplied with a charge of fuel through either carburetion or fuel injection so that the charge of fuel, when mixed with the induction air charge, provides a combustible mixture to the engine combustion chambers or cylinders. The quantity of the fuel supplied to the engine can be regulated by a number of different means.

In most present aircraft piston engines, however, the fuel system may be manually controlled by means of a mixture control lever. This lever is operated by the pilot to provide leaner fuel mixtures to the engine for improved fuel economy and also to avoid excessively rich mixtures at higher altitudes. Such excessively rich mixtures can result in inconsistent engine combustion and even stalling of the engine.

Normally the mixture control lever of the aircraft is operated by the pilot in response to one or more predetermined engine operating parameters such as the exhaust gas temperature (EGT), the cylinder head temperature (CHT), the fuel flow rate, the altitude, the engine speed and/or the manifold pressure. Consequently, the control and adjustment of the mixture control lever by the pilot unduly increases the pilot workload and at the same time can result in an improper fuel mixture to the engine. An improper fuel mixture to the engine can result not only in excessive fuel consumption but also in engine damage from excessive cylinder head temperature.

SUMMARY OF THE PRESENT INVENTION

The present invention overcomes the disadvantages of the previously known fuel mixture control systems by providing an automatic fuel mixture control system which automatically minimizes the brake specific fuel consumption during operation at constant engine rotational speed and load and yet enriches the fuel mixture during transient operation. The system also prevents prolonged operation of the engine at excessive cylinder head temperatures.

In brief, the present invention comprises a microcomputer fuel mixture control system for an aircraft piston engine having a source of fuel and means for supplying the fuel to the engine at variable flow rates. Assuming that the aircraft engine is operating at constant engine rotational speed and load, the system automatically senses and determines the magnitude of an engine parameter which is correlated to the brake specific fuel consumption for the engine. In the example to be subsequently described in greater detail, the exhaust gas temperature (EGT) is used as its parameter although other engine parameters could also be used.

The value of the exhaust gas temperature is then compared with its previously determined value and, as a result of this comparison, the fuel flow rate to the engine is stepwise increased or stepwise decreased by predetermined fuel flow rate increments in a direction designed to minimize the brake specific fuel consumption and thus provide maximum fuel economy for the engine within the constraints of a given engine operating condition.

The process of comparing the exhaust gas temperature with its previous value is iteratively repeated until the exhaust gas temperature approaches a point relative to the location of peak exhaust gas temperature correlating to the minimum brake specific consumption. At this time, the fuel flow to the engine is alternatively stepwise increased and stepwise decreased by decreasing fuel flow rate increments until the fuel flow rate increment is less than a predetermined amount. At this time, the iteration cycle is completed and the fuel flow rate to the engine is maintained at the final value until a change in the engine operating cycle occurs.

The fuel control system of the present invention further iteratively senses and determines an engine parameter, such as the manifold air pressure of the engine or throttle plate angle, which is indicative of the power requirements for the engine. When this parameter exceeds a predetermined value indicating that additional power is necessary, the system automatically increases the fuel flow rate to the engine and maintains the fuel flow to the engine at an amount slightly richer than that flow corresponding to the maximum allowable cylinder head temperature thus maximizing the engine power. When the engine power requirements again fall below this predetermined amount, the control system again leans the fuel supply to the engine and minimizes the brake specific fuel consumption for best fuel economy in the previously described fashion.

BRIEF DESCRIPTION OF THE DRAWINGS

A better understanding of the present invention will be had upon reference to the following detailed description, when read in conjunction with the accompanying drawings, wherein like reference characters refer to like parts throughout the several views, and in which:

FIG. 3 is a diagramatic view illustrating portions of the fuel control system according to the present invention; and FIG. 4 is a graph illustrating the operation of the fuel control system according to the present invention.

DETAILED DESCRIPTION OF THE PRESENT INVENTION

Figure 1:
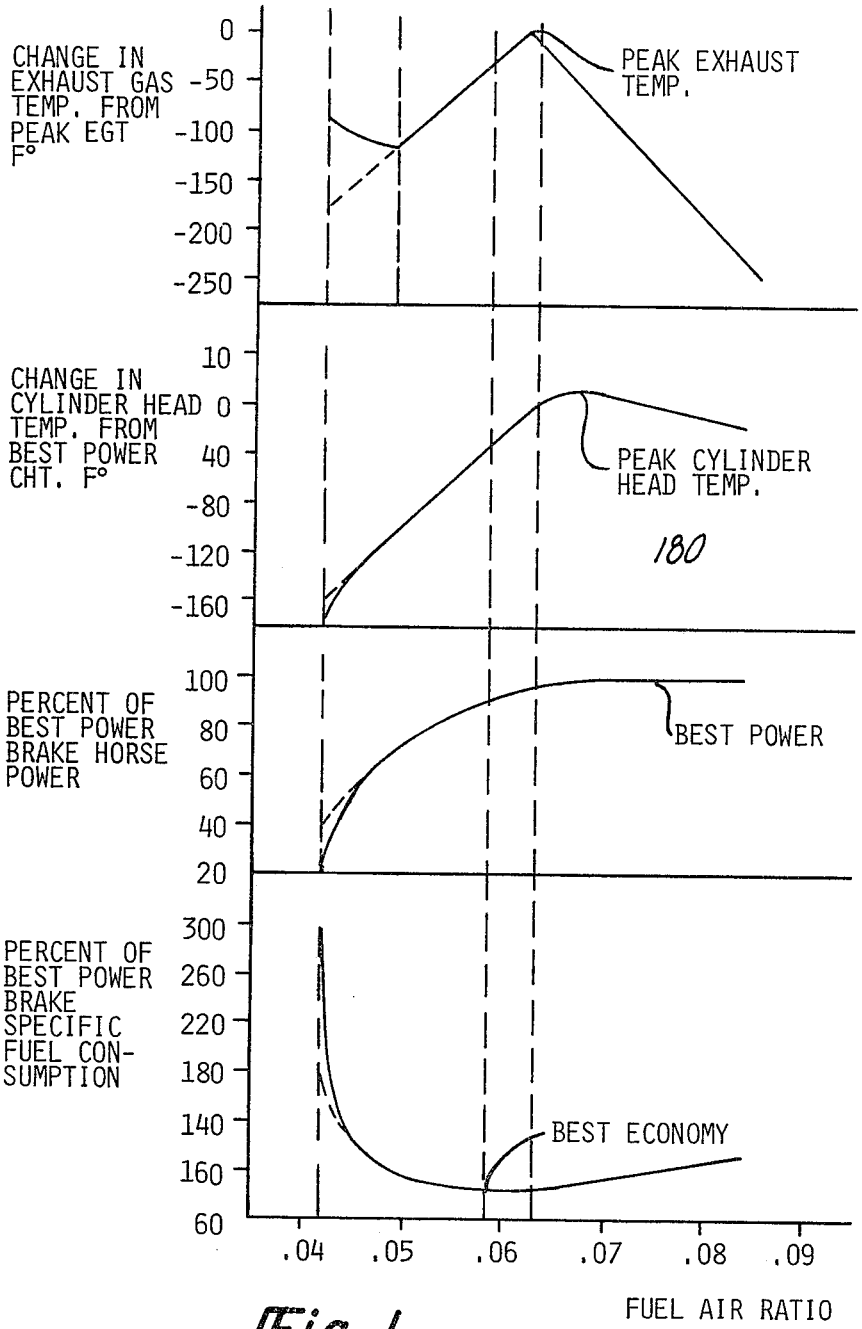
FIG. 1 is a series of graphs illustrating the effect of the fuel-air ratio on four engine parameters.

With reference to FIG. 1, the effect of the fuel-air ratio for a spark-ignition internal combustion engine verses several engine parameters is shown. At the top of FIG. 1, the exhaust gas temperature for the engine is plotted on the vertical axis while the fuel-air ratio is plotted on the horizontal axis. The exhaust gas temperature reaches a peak at a fuel-air ratio of about 0.0620 (for the example used) and decreases substantially linearly as the fuel-air ratio is either decreased or increased.

Still referring to FIG. 1, the second from the top chart plots the cylinder head temperature on the vertical axis verses the fuel-air ratio on the horizontal axis. As can be seen from FIG. 1, the cylinder head temperature increases substantially linearly as the fuel-air ratio is increased to about 0.0675 and thus achieves its maximum temperature at a fuel-air ratio slightly richer than the peak exhaust temperature. Further enrichment of the fuel-air mixture to the engine will result in a slight decrease in the cylinder head temperature. Moreover, the operation of the internal combustion engine for a sustained period above a maximum cylinder head temperature can result in damage to the engine and thus must be avoided.

Still referring to FIG. 1, the third graph from the top illustrates the engine power as a function of the fuel-air ratio. As can be seen from the chart, the engine power increases with an increase of the fuel-air ratio until the maximum engine power is obtained after which the engine power remains substantially constant regardless of an increase in the fuel-air ratio. In addition, as shown in FIG. 1, the best power for the engine is obtained at a fuel-air ratio of about 0.076 and thus substantially greater than the fuel-air ratio corresponding to either the peak exhaust gas temperature or the peak cylinder head temperature.

Still referring to FIG. 1, the bottom-most graph depicts the brake specific fuel consumption as a function of the fuel-air ratio. The minimum point on this curve correlates to the best fuel economy and, as shown, occurs at a fuel-air ratio of approximately 0.0590 and increases substantially as the fuel-air ratio is enriched or leaned. Moreover, the best economy point on the brake specific fuel consumption curve occurs at a fuel-air ratio slightly leaner than the peak exhaust gas temperature shown at the top of FIG. 1.

From FIG. 1 it can be seen that the specific fuel consumption is correlated to the peak exhaust gas temperature for the engine and the minimum specific fuel consumption is achieved at a fuel-air ratio slightly less than the peak exhaust gas temperature. Moreover, the engine (not shown) includes conventional temperature probes 206 and 208 (FIG. 3) to determine the exhaust gas temperature and the cylinder head temperature, respectively. These probes are of a conventional construction and, for that reason, will not be further described.

The logic of the fuel control system according to the present invention is preferably implemented by a microcomputer 200 (FIG. 3). For example, however, one means of controlling the fuel delivery rate for a fuel system in which the fuel flow rate is at least partly controlled by the fuel pump outlet pressure would be to control the activation of a variable fuel bypass valve 204 by a stepper motor 202.

Figure 2A:
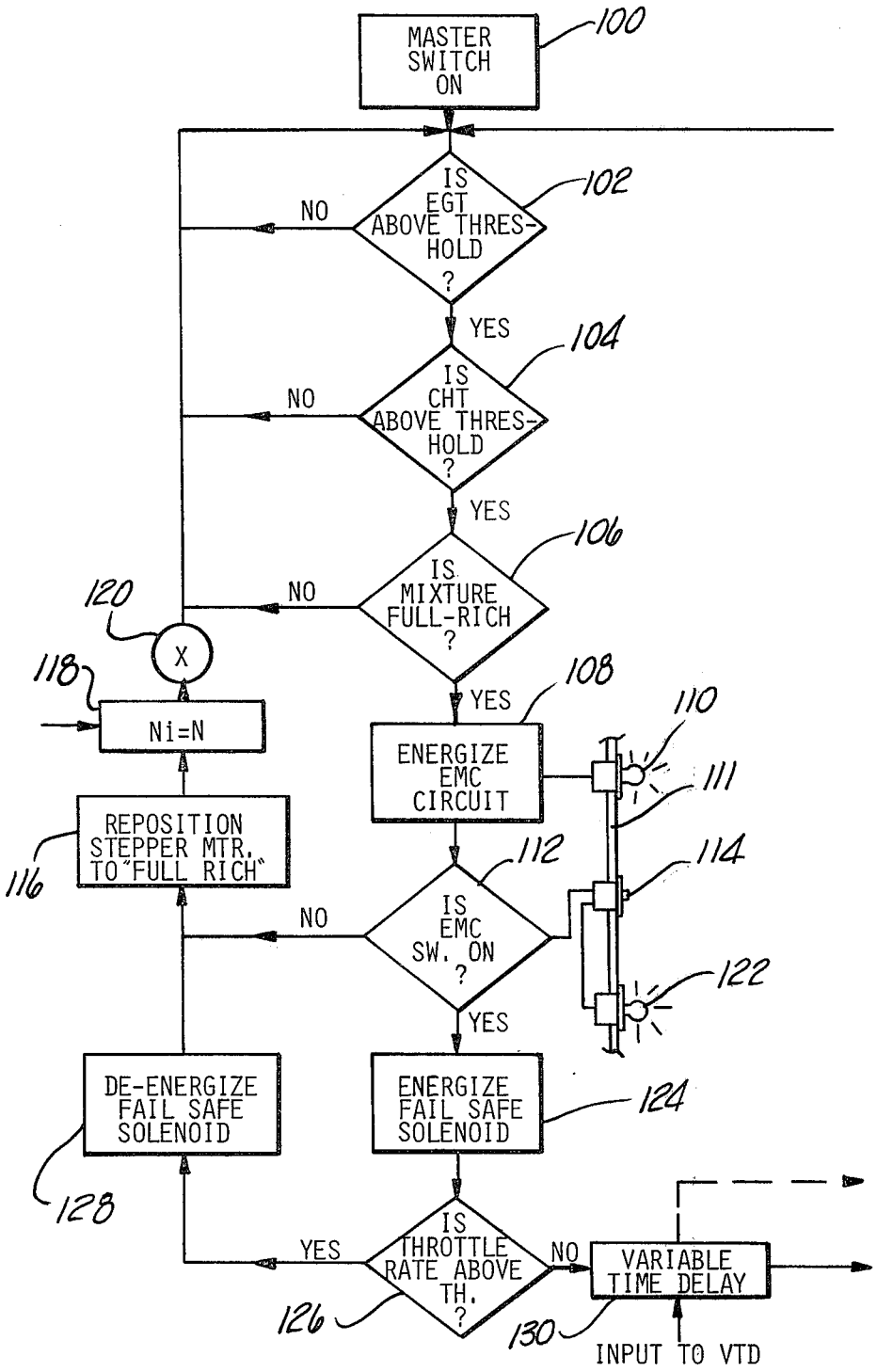
FIGS. 2A and 2B depict a flow chart showing the operation of the fuel control system according to the present invention.

The process used to compute the fuel delivery rate will now be described with reference to the flow chart shown in FIGS. 2A and 2B and by using a reciprocating piston aircraft engine as the example engine. With reference first then to FIG. 2A, a master switch at step 100 is used to activate the electrical system of the aircraft.

At step 102, the microcomputer senses the value of the exhaust gas temperature and determines if the exhaust gas temperature is above a minimum threshold value indicating that the engine is within its normal operating temperature range. If the exhaust gas temperature is not within its normal operating range, indicating that the engine has not been started, or has been only recently started, step 102 is continuously repeated until the exhaust gas temperature is above its minimum threshhold value.

After the exhaust gas temperature has reached a minimum threshhold value, the microcomputer senses this and determines the cylinder head temperature at step 104 to insure that the cylinder head temperature, like the exhaust gas temperature, has reached a predetermined minimum threshold value indicative that the cylinder head temperature is within its normal operating temperature range. If the cylinder head temperature has not yet reached its range of normal operating temperatures, control is again returned to step 102 and the process is repeated.

At step 106, the position of the manual mixture control lever for the engine is sensed by the control system. If the control lever is not in its full rich position, step 106 again branches control back to step 102 and the process is reiterated until the control lever is positioned in its full rich position.

Assuming that both the exhaust gas temperature and cylinder head temperature continue to be within their normal operating ranges and that the manual fuel mixture control lever is in its full rich position, step 108 activates the EMC circuit and simultaneously illuminates an indicator light 110 on the pilot's control panel 111 indicating that automatic control of the fuel delivery is possible.

At step 112 the position of the automatic fuel control system switch 114 on the pilot's control panel 111 is sensed. Since the switch is initially in the off position, i.e. during engine start up, the microcomputer at its first pass initially repositions the stepper motor switch to full rich at step 116. Thereafter, the microcomputer presets a value N(i) to an initial value of N at step 118 and thereafter presets a control factor to a value X at 120. For the example used, N equals 64. Both the control factor X and the value in N(i) will be subsequently described in greater detail. Following step 120, program control is again returned to step 102.

The pilot can activate the automatic control system according to the present invention by activating switch 114 on the control panel 111 which simultaneously illuminates an indicator light 122 on the pilot control panel 111. Thus, upon the next execution of step 112, program control is passed to a step 124 which energizes a failsafe solenoid (not shown) in the fuel control system which would return the fuel system to normal full-rich fuel-air ratio in the event of an electrical power failure. The failsafe solenoid enhances system safety for the aircraft engine.

Following energization of the failsafe solenoid, at step 124 the system detects any throttle movement at step 126 via a conventional position transducer 210 (FIG. 3). If the throttle rate exceeds a predetermined value, indicating an abrupt increase or decrease in engine power, the failsafe solenoid is deactivated at step 128 and system control is again returned to step 102 via steps 116, 118 and 120.

If the throttle rate movement is not above a predetermined threshold, indicating that the engine is operating at a steady-state speed, program control passes from step 126 to a variable time delay 130. The operation of the variable time delay 130 will be subsequently described in greater detail but, under normal steady-state conditions, program control passes directly from the variable time delay 130 to step 132 shown in FIG. 2B. At step 132, the system senses and determines the manifold air pressure for the engine via a pressure transducer 212 (FIG. 3) to determine whether or not the engine is operating above its maximum allowable cruise power level, typically 75 percent of the engine power. Assuming that the manifold air pressure is less than the predetermined threshold, indicative that the engine is below its maximum allowable cruise power program control is then passed to step 134.

At step 134, the program senses and determines the value of the cylinder head temperature via conventional temperature transducers and insures that it is less than a maximum amount, i.e. 460 degrees Fahrenheit for the example shown. Sustained engine operation above the maximum allowable cylinder head temperature can result in damage to the engine.

Assuming, however, that the engine is operating below the maximum allowable cruise power and also that the cylinder head temperature is below the maximum allowable amount, the system then reads the exhaust gas temperature at step 136 and simultaneously sets the initial value of the exhaust gas temperature, $EGT_o$, at zero. The initial value of the exhaust gas temperature, namely $EGT_o$, however, is preset at zero only during the first iteration through the system loop shown in FIG. 2B.

At step 138, the value of the exhaust gas temperature as determined in step 136 is assigned to the value of $EGT_1$.

Following step 138, the value of N(i) is tested at step 140 to determine if N(i) equals two (2). Initially, N(i) is set to the value of N at step 118 which is preferably two (2) raised to an integer power. For the example show, N equals 64 or $2^6$. As will become shortly apparent, the value of N is related to the number of iterations which the system conducts in adjusting the fuel supply rate to the engine in order to obtain maximum fuel economy, and is also related to the magnitude of the stepwise increase or decrease of the fuel flow increments.

Since the initial value of N is greater than 2, the fuel control system then compares the value of $EGT_1$ with the value of $EGT_o$ at step 142. Assuming that the present value of the exhaust gas temperature $EGT_1$ exceeds the previously determined value for the exhaust gas temperature $EGT_o$ as would occur in the first iteration since $EGT_o$ is initially preset to zero by step 136, program control is then passed to step 144 which determines which control factor X or Y has been currently set by the control system. For the current example, the control factor was initially preset at X so that the system control is directly passed to step 146. Alternatively, if the control factor is set to Y at step 144, the value N(i) is divided in half at step 148 and then control is passed to step 146.

At step 146, the program energizes an electromechanical device to decrease the fuel flow by an increment proportional to the existing value of N(i). Preferably, a stepper motor is used to decrease the fuel flow from the fuel source to the engine and, in this case, the stepper motor is activated by N(i) or 64, steps. On the other hand, if the control factor Y had been set by the program and tested at step 144, the stepper motor used to decrease the fuel flow to the engine would be activated by only 32 steps since step 148 halves the current value of N(i).

Following step 146, the control factor X is set at step 150, the value of $EGT_1$ is assigned to the value of $EGT_0$ at step 152 and program control is again returned to step 102 (FIG. 2A).

Still referring to FIG. 2B, assuming that the engine remains below its maximum allowed cruise power level and that the cylinder head temperature remains below its maximum allowable level, steps 136–152 are continuously reiterated thus reducing the fuel flow to the engine by the initial fuel flow increment (i.e. 64 steps of the stepping motor) until the current value for the exhaust gas temperature $EGT_1$ is less than the previously determined value for the exhaust gas temperature $EGT_0$ as determined at step 142. Such a condition would occur when the decrease in the fuel flow performed at step 146 has sufficiently leaned the fuel-air ratio to an amount less than 0.0620 (FIG. 1) and thus to the left side of the peak exhaust gas temperature illustrated in the top graph of FIG. 1. In this event, step 142 passes control to step 154 which determines which control factor X or Y is currently set by the system. Since the control factor X has been previously set in step 150, control is then passed to step 156, which halves the value of N(i) and then to step 158.

At step 158, the fuel flow to the engine is increased by N(i)/2 steps of the stepper motor. Thus, steps 156 and 158 taken together increase the fuel flow to the engine by an increment equal to one-fourth the previous decrease of the fuel flow to the engine. Step 158 also has the effect of increasing the exhaust gas temperature toward its peak value shown in the top graph in FIG. 1.

Following step 158, the control factor Y is set at step 160 and the iteration loop continues from 152 and to step 136.

The current value for the exhaust gas temperature $EGT_1$ is again determined at steps 136 and 138 and this value is compared to the previously determined value for the exhaust gas temperature $EGT_0$ at step 142. Assuming that the increase of the flow rate to the engine increases the exhaust gas temperature in the expected fashion, the system sequentially executes steps 144, 148 and 146 thus decreasing the fuel flow rate to the engine by the current value of N(i) (reset at step 148) steps of the stepper motor and the control loop is again reiterated. Assuming, however, that the current value of the exhaust gas temperature $EGT_1$ as determined in step 142 is less than the previously determined value of the exhaust gas temperature $EGT_0$ system control is then passed to step 154 rather than step 144. Such a condition could exist in the event that the increase of the fuel flow rate caused by the previous execution of step 158 was sufficiently large to cause the exhaust gas temperature to pass from the left side of the peak exhaust gas temperature (FIG. 1) and to its right half. In this event, since the control factor Y has been set, step 154 transfers this control directly to step 146 which decreases the fuel flow rate to the engine in order to reduce the fuel-air ratio to the left side of the peak exhaust gas temperature (FIG. 1) and thus towards the fuel-air ratio necessary for best fuel economy.

Figure 2B:
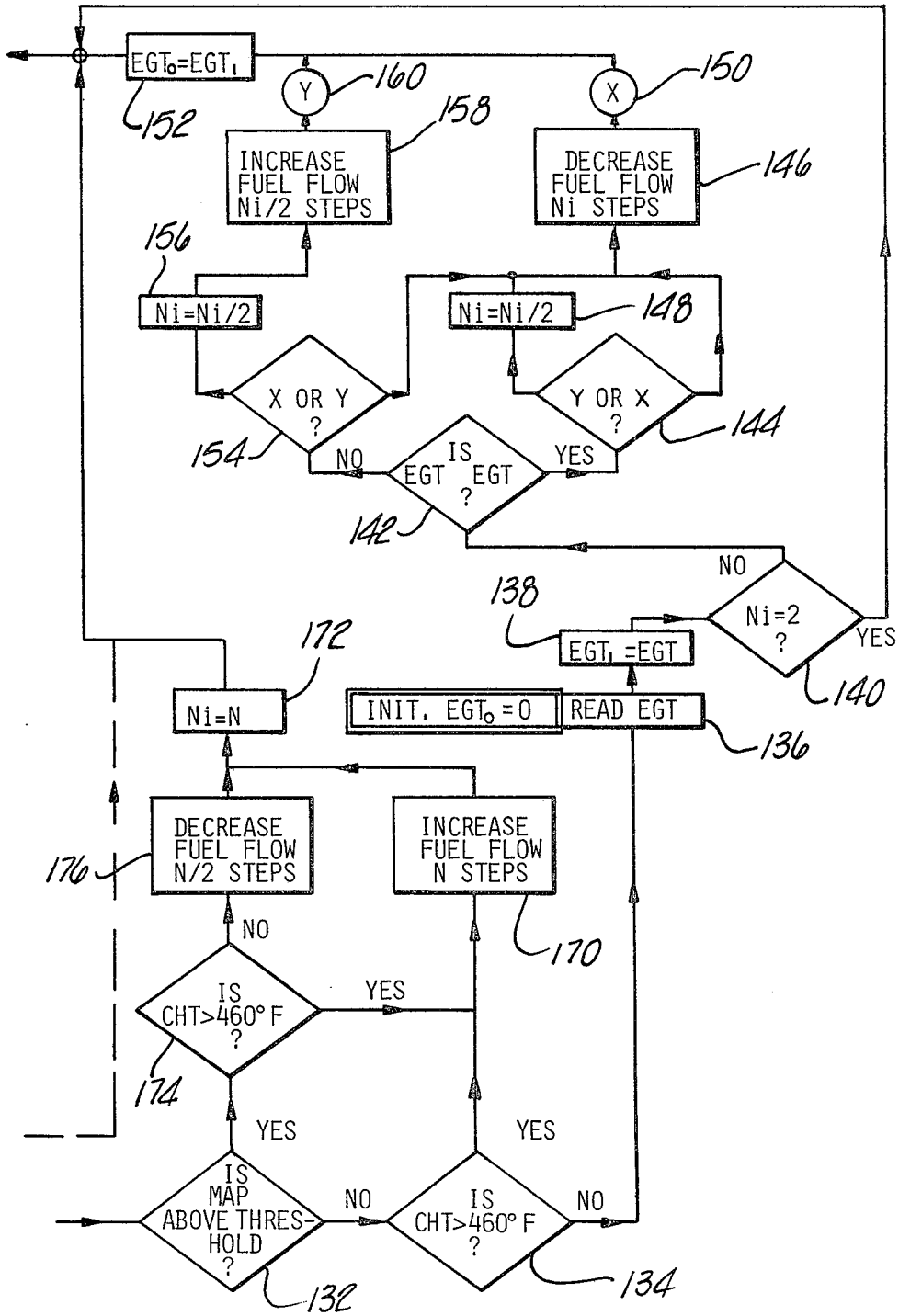

Still referring to FIG. 2B, both steps 156 and 148, when executed, decrease the value of N(i) by one-half. Thus, when N(i) is initially preset to 64, after steps 156 and 158 have been collectively executed six times, the value of (Ni) equals two. At this time, step 140 completely bypasses steps 146 and 158 so that the fuel flow rate to the engine is maintained at the current value.

The complete iteration process for the fuel delivery control system according to the present invention can be summarized with reference to FIG. 4 and the following chart:

| | ITERATION LOOP NUMBER | | | | | | | | | |
|---|---|---|---|---|---|---|---|---|---|---|
| | 1 | 2 | 3 | 4 | 5 | 6 | 7 | 8 | 9 | HOLD VALUE |
| BSFC | .5070 | .4690 | .4340 | .4100 | .4000 | .4020 | .4000 | .4005 | .4000 | .4001 |
| EGT | 1387.0 | 1432.0 | 1494.0 | 1521.0 | 1495.0 | 1502.0 | 1495.0 | 1496.0 | 1495.0 | 1495.1 |
| $EGT_o$ | 0* | 1387.0 | 1432.0 | 1494.0 | 1521.0 | 1495.0 | 1502.0 | 1495.0 | 1496.0 | 1495.0 |
| $EGT_1 > EGT_o$? | Yes | Yes | Yes | Yes | No | Yes | No | Yes | No | — |
| X or Y? | X** | X | X | X | X | Y | X | Y | X | Y |
| N(i) | 64 | 64 | 64 | 64 | 32 | 16 | 8 | 4 | 2 | 2 |
| Fuel Flow Step Change (+ or −) | −64 | −64 | −64 | −64 | +16 | −16 | +4 | −4 | +1 | — |
| Fuel Flow Change (lbs/hr) | −7.500 | −7.500 | −7.500 | −7.500 | +1.875 | −1.875 | +0.47 | −0.47 | +0.12 | — |
| SET X or Y? | X | X | X | X | Y | X | Y | X | Y | X |
| NEW FUEL FLOW | 100.00 | 92.50 | 85.00 | 77.50 | 79.375 | 77.50 | 77.97 | 77.50 | 77.62 | 77.62 |

*Initial Value $EGT_o = 0$
**Initial Value X or Y = X

In FIG. 4, curve A represents the exhaust gas temperature while curve B represents the brake specific fuel consumption. The best fuel economy for the engine is, of course, obtained at the minimum value of the specific fuel consumption. In addition, the horizontal axis of FIG. 4 represents the fuel flow to the engine in pounds per hour. The iteration loops are sequentially numbered from one to nine in both the graph of FIG. 4 and also in the above chart. Each iteration loop, of course, represents one pass through steps 136–152. Although the chart and the graph of FIG. 4 are self-explanatory, in brief, from iteration loops numbered one to four, the fuel flow rate to the engine is substantially rich of the point for the maximum exhaust gas temperature.

Iteration loop numbers five to nine alternatively increase and decrease the fuel flow rate to the engine in decreasing fuel flow increments so that at iteration loop number nine the exhaust gas temperature is substantially aligned with the minimum point for the brake specific fuel consumption and, hence, maximum fuel economy is achieved. In addition, at iteration loop number nine the value of N(i) has been reduced to two thus terminating further adjustments of the fuel flow rate.

Referring again to FIG. 2B, in the event that the cylinder head temperature exceeds its maximum allowable value of 460 degrees Fahrenheit for the example shown, the previously described steps 136–160 to maximize fuel economy are ignored and instead step 134 transfers system control to step 170 which increases the fuel flow rate to the engine by N steps of the stepping motor. This increase of fuel flow to the engine reduces the cylinder head temperature and thus prevents damage to the engine which can be caused by sustained engine operation at an excessive cylinder head temperature. Following step 170, the value of N(i) is reset to the initial value of N (64) at step 172 and the system control is then transferred to step 102 where the entire previously described iteration process is repeated.

Still referring to FIG. 2B, in the event that the manifold air pressure exceeds its maximum threshold value, the previously described iteration process to achieve maximum fuel economy is likewise ignored and, instead, step 132 transfers system control to step 174. An increase of the manifold air pressure above its threshold value is indicative that the engine power requirements exceed the cruise power range for the engine.

At step 174, the value of the cylinder head temperature is compared with its maximum allowable temperature of 460 degrees F. If the cylinder head temperature exceeds its maximum allowable value, steps 170 and 172 are sequentially executed thus increasing the fuel flow rate to the engine and simultaneously reducing the cylinder head temperature. Conversely, if the cylinder head temperature is less than its maximum allowable amount, step 174 transfers control to step 176 which decreases the fuel flow to the engine by N/2 steps of the stepping motor. This loop, in effect, maintains the fuel flow rate to the engine at N/2 increments of the stepping motor richer than the maximum allowable cylinder head temperature and thus at or near the point of best engine power as shown by line 180 in FIG. 1.

As previously described, the electromechanical components necessary to carry out the fuel control functions are of a conventional nature and, therefore, are not shown and will not be described in great detail. However, a stepping motor is utilized to vary the fuel flow rate from the fuel source and to the engine. The fuel flow adjustment caused by activation of the stepping motor is proportional to the number of steps for which the motor is activated. The electromechanical system does, however, include a failsafe solenoid so that upon failure of the electrical power supply, the fuel system would return to normal full-rich fuel-air ratio operation.

It can, therefore, be seen that the fuel flow control system according to the present invention provides a novel means for maximizing fuel economy of the engine within recommended operating limits and yet permits the attainment of maximum engine power when the maximum allowable cruise power limit of the engine is exceeded. Moreover, the system is unique in that it is unnecessary to know the absolute value of the exhaust gas temperature or the absolute value of its peak exhaust gas temperature in order to obtain the region for best fuel economy below the maximum allowable cruise power limit of the engine. As such, the system according to the present invention is widely applicable to many operating modes and engine sizes. The present fuel control system is further advantageous in that it enjoys a low total system cost in that many of the control signals, such as exhaust gas temperature and cylinder head temperature, are normally available in aircraft piston engines and that the use of expensive fuel and air flow transducers to control the fuel-air ratio is totally avoided.

Having described my invention, however, many modifications thereto will become apparent to those skilled in the art to which it pertains without deviation from the spirit of the invention as defined by the scope of the appended claims.

I claim:

1. A fuel control system for an internal combustion engine comprising:

means for sensing the temperature of the exhaust gases from said engine, wherein the temperature of the exhaust gases decreases from a peak value as the fuel mixture to the engine is either enriched or leaned;

means for ensuring that the fuel-air ratio is initially richer than the fuel-air ratio corresponding to the peak exhaust gas temperature;

means for repeatedly decreasing the fuel flow rate to the engine by predetermined fuel flow increments until the exhaust gas temperature is less than the previously determined exhaust gas temperature so that the fuel-air ratio is less than that corresponding to the peak exhaust gas temperature; and means for thereafter alternately decreasing and increasing the fuel flow rate to the engine in predetermined and progressively decreasing increments until the fuel flow increment is less than a predetermined amount and thereafter maintaining a constant fuel flow rate.

2. The invention as defined in claim 1 and further comprising:

means for sensing the temperature of the cylinder head temperature of the engine; and means for increasing the fuel flow rate to the engine by a predetermined amount when the cylinder head temperature exceeds a predetermined temperature.

3. The invention as defined in claim 2 and further comprising:

means for sensing the manifold pressure of the engine;

means for increasing the fuel flow to the engine by a predetermined amount when the manifold pressure exceeds a predetermined pressure and when the cylinder head temperature exceeds said predetermined temperature; and means for decreasing the fuel flow to the engine by a fractional portion of said predetermined amount when said manifold pressure exceeds said predetermined pressure and when said cylinder head temperature is less than said predetermined temperature.

4. The invention as defined in claim 1 wherein the means for increasing the fuel flow rate to the engine comprises a stepper motor operatively connected to a fuel control valve means.

5. A method for fuel control for an engine having a source of fuel and means for supplying fuel from the fuel source and to the engine at variable flow rates, said method comprising the steps of:

(a) presetting an initial fuel increment;

(b) presetting a control factor to a first of two values;

(c) sensing the engine exhaust gas temperature and generating an output signal representative of the magnitude of said exhaust gas temperature;

(d) comparing the magnitude of said exhaust gas temperature with the magnitude of the previously sensed value of the exhaust gas temperature;

(e) if the magnitude of the presently sensed exhaust gas temperature exceeds the magnitude of the previously sensed exhaust gas temperature;

(i) if said control factor is set at its first value, decreasing the fuel flow increment;

(ii) if said control factor is set at its second value, resetting said fuel increment to a fractional portion of its present value, decreasing the fuel flow rate to said engine by a fraction of the fuel increment and resetting the control factor to its first value;

(f) if the magnitude of the previously sensed exhaust gas temperature exceeds the magnitude of the presently sensed exhaust gas temperature;

(i) if said control factor is set to its second value, decreasing the fuel flow rate to said engine and resetting the control factor to its first value;

(ii) if said control factor is set to said first value, resetting said fuel increment to a fractional portion of its present value, increasing the fuel flow rate to said engine by a fractional portion of the fuel increment, and resetting said control factor to its second value;

(g) Reiterating steps c–f above until the fuel increment is smaller than a predetermined amount.

6. The invention as defined in claim 5 wherein said engine is a reciprocating piston engine and further comprising the steps of sensing the cylinder head temperature, increasing the fuel flow rate to the engine by said fuel increment when the cylinder head temperature exceeds a predetermined amount.

7. The invention as defined in claim 6 and further comprising the step of resetting the fuel increment to its initial value.

8. The method as defined in claim 5 and further comprising the steps of:

(a) determining the manifold air pressure;

(b) determining the cylinder head temperature;

(c) increasing the fuel flow rate to said engine by said fuel increment if the manifold air pressure exceeds a predetermined threshold and the cylinder head temperature exceeds a predetermined value;

(d) decreasing the fuel flow rate to said engine by a fractional portion of the fuel increment if the manifold air pressure exceeds said predetermined threshold and said cylinder head temperature is less than said predetermined value;

(e) reiterating steps a–d.

9. The method as defined in claim 8 and further comprising the step of resetting said fuel increment to its initial value.

* * * * *

UNITED STATES PATENT AND TRADEMARK OFFICE

CERTIFICATE OF CORRECTION

PATENT NO. : 4,305,364

DATED : December 15, 1981

INVENTOR(S) : Kenneth J. Stuckas

It is certified that error appears in the above-identified patent and that said Letters Patent are hereby corrected as shown below:

Column 3, line 63, delete "threshhold" and insert --threshold--.

Column 3, line 65, delete "threshhold" and insert --threshold--.

Signed and Sealed this

*Twenty-third* Day of *March 1982*

[SEAL]

*Attest:*

GERALD J. MOSSINGHOFF

*Attesting Officer*

*Commissioner of Patents and Trademarks*